US007075358B1

(12) United States Patent
Voo

(10) Patent No.: US 7,075,358 B1
(45) **Date of Patent: *Jul. 11, 2006**

(54) BASE CURRENT COMPENSATION FOR A BIPOLAR TRANSISTOR CURRENT MIRROR CIRCUIT

(75) Inventor: Thart Fah Voo, Singapore (SG)

(73) Assignee: Marvell International Ltd., Hamilton (BM)

( * ) Notice: Subject to any disclaimer, the term of this patent is extended or adjusted under 35 U.S.C. 154(b) by 0 days.

This patent is subject to a terminal disclaimer.

(21) Appl. No.: 11/204,481

(22) Filed: Aug. 15, 2005

Related U.S. Application Data

(63) Continuation of application No. 10/792,485, filed on Mar. 2, 2004, now Pat. No. 6,956,428.

(51) Int. Cl.
*G05F 1/10* (2006.01)

(52) U.S. Cl. ..... 327/538

(58) Field of Classification Search ..... 327/315, 327/316, 530, 534, 535, 538, 540, 541, 543
See application file for complete search history.

(56) References Cited

U.S. PATENT DOCUMENTS

| | | | |
|---|---|---|---|
| 5,625,281 | A | 4/1997 | Lambert |
| 5,805,015 | A | 9/1998 | Burccoleri et al. |
| 6,069,520 | A | 5/2000 | Yamamoto et al. |
| 6,407,620 | B1 | 6/2002 | Hirayama |
| 6,538,495 | B1 | 3/2003 | Goutti et al. |
| 6,747,508 | B1 | 6/2004 | Liu et al. |
| 6,794,928 | B1 | 9/2004 | Lei |

FOREIGN PATENT DOCUMENTS

| | | |
|---|---|---|
| WO | WO 01/02925 | 1/2001 |

*Primary Examiner*—Jeffrey Zweizig

(57) ABSTRACT

A stable current mirror circuit that includes base current compensation is provided—i.e., a feedback loop in the current mirror circuit (used to perform base current compensation) does not have a tendency to oscillate. In addition, base current compensation is achieved in the current mirror circuit using a minimum number of circuit elements that can be easily scaled for reduced power consumption and size.

27 Claims, 3 Drawing Sheets

BASE CURRENT COMPENSATION FOR A BIPOLAR TRANSISTOR CURRENT MIRROR CIRCUIT

CROSS-REFERENCE TO RELATED APPLICATION

This application is a continuation (and claims the benefit of priority under 35 USC 120) of U.S. application Ser. No. 10/792,485, filed Mar. 2, 2004, now U.S. Pat. No. 6,956,428. The disclosure of the prior application is considered part of (and is incorporated by reference in) the disclosure of this application.

BACKGROUND

The following disclosure relates to electrical circuits and methods for processing signals.

An often-used circuit applying a bipolar transistor is a current mirror circuit. A current mirror circuit generally serves as a current regulator (or current source), supplying a nearly constant current to one or more loads (or circuits).

FIG. 1 shows a conventional current mirror circuit 100. Current mirror circuit 100 includes a reference current source $I_{REF}$ and a master bipolar transistor $Q_i$, and slave bipolar transistors $Q_1$, $Q_2$, . . . $Q_n$. The bases of master bipolar transistor $Q_i$ and slave bipolar transistors $Q_1$ $Q_2$, . . . $Q_n$ are commonly connected. Each slave bipolar transistor $Q_1$ $Q_2$, . . . $Q_n$ mirrors reference current $I_{REF}$ (i.e., the collector current of master bipolar transistor $Q_i$) to produce output currents $I_1$, $I_2$, . . . $I_n$, respectively. Output currents $I_1$, $I_2$, . . . $I_n$, can be supplied to a variety of electrical circuits represented by circuits 102-1, 102-2, . . . 102-n.

Some current mirror circuits include base current compensation to reduce base current-related errors. Base current-related errors arise due to current loss from a reference current source (e.g., $I_{REF}$) being reflected at the commonly connected bases of the slave transistors in a current mirror circuit. As shown in FIG. 1, current mirror circuit 100 further includes a compensating bipolar transistor $Q_B$ that performs base current compensation through a current feedback loop 104. A common problem associated with a current feedback loop, such as current feedback loop 104, is a tendency towards oscillation. To prevent oscillation, a current mirror circuit may include a current source (in addition to the reference current source), and one or more capacitors to stabilize the current feedback loop. For example, current mirror circuit 100 includes capacitors $C_A$ and/or $C_B$, and a relatively large current source $I_C$ (that increases a gain of bipolar transistor $Q_B$ and prevents oscillation in current feedback loop 104).

SUMMARY

In general, in one aspect, this specification describes a current mirror circuit. The current mirror circuit includes a reference current source and one or more slave bipolar transistors each configured to mirror the reference current source in accordance with a master bipolar transistor. The current mirror circuit further includes a compensation circuit configured to generate a compensating base current to the one or more slave bipolar transistors. A value of the compensating base current generated by the compensation circuit is substantially equal to $(n+1)I_B$, in which n is equal to a total number of the one or more slave bipolar transistors, and $I_B$ represents a base current flowing to the master bipolar transistor.

Particular implementations can include one or more of the following features. The compensation circuit can include a mirror circuit including a first transistor and a second transistor. The first transistor can be configured to receive a reference current equal to $I_B$, and the second transistor can be configured to generate an output current having a value substantially equal to $(n+1)I_B$. The first transistor and the second transistor can be sized differently. The first transistor and the second transistor can be MOSFET transistors having a width-to-length ratio of 1:(n+1), respectively. The first transistor and the second transistor can be bipolar transistors, in which the second transistor has an emitter area that is larger than an emitter area of the first transistor. The compensation circuit can further include a compensating bipolar transistor connected to the first transistor of the current mirror circuit and connected to the master bipolar transistor. The compensating bipolar transistor can be configured to supply the reference current equal to $I_B$ to the first transistor of the current mirror circuit.

In general, in another aspect, this specification describes a current mirror circuit having a first transistor of a first conductive type, a second transistor of the first conductive type, a third transistor of the first conductive type, a fourth transistor having three terminals, a fifth transistor having three terminals, and a plurality of sixth transistors of the first conductive type.

The first transistor has a collector and a base each connected to a reference current source. The second transistor has a base that is connected to the base of the first transistor. The third transistor has an emitter connected to a collector of the second transistor. The fourth transistor has a first terminal connected to a power supply, and a second and third terminal each connected to a base of the third transistor. The fifth transistor has a first terminal connected to a power supply, a second terminal connected to the second terminal of the fourth transistor and connected to the third terminal of the fourth transistor, and a third terminal connected to a junction between the bases of the first transistor and the third transistor. Each of the plurality of sixth transistors have a base connected to the base of the first transistor.

Particular implementations can include one or more of the following features. The first conductivity type can be NPN or PNP. The fourth transistor and the fifth transistor can be p-type MOSFET transistors. The fourth transistor and the fifth transistor can have a different width-to-length size ratio. The width-to-length size ratio of the fourth transistor to the fifth transistor can be 1:(n+1), where n is the number of transistors having bases that are commonly connected to the base of the first transistor. The fourth transistor and the fifth transistor can be bipolar transistors. The bipolar transistors can have different emitter areas.

In general, in another aspect, this specification describes a disk drive system. The disk drive system includes a read head configured to sense changes in magnetic flux on a surface of a disk, and generate a corresponding analog read signal. The disk drive further includes a preamplifier configured to receive the analog read signal, and amplify the analog read signal using one or more current sources from a current mirror circuit; and a read channel configured to receive the amplified analog read signal and generate a digital read signal based on the amplified analog read signal.

The current mirror circuit includes a reference current source and one or more slave bipolar transistors each configured to mirror the reference current source in accordance with a master bipolar transistor, and supply an output current as a current source to the preamplifier. The current mirror circuit further includes a compensation circuit configured to generate a compensating base current to the one or more slave bipolar transistors, in which n is equal to a total number of the one or more slave bipolar transistors, and $I_B$ represents a base current flowing to the master bipolar transistor.

In general, in another aspect, this specification describes a method for generating a compensating base current for a bipolar transistor current mirror circuit. The method includes generating a reference current source, mirroring the reference current source using one or more slave bipolar transistors in accordance with a master bipolar transistor, and generating a compensating base current that is supplied to the one or more slave bipolar transistors. A value of the compensating base current is substantially equal to $(n+1)I_B$, in which n is equal to a total number of the one or more slave bipolar transistors, and $I_B$ represents a base current flowing to the master bipolar transistor.

Implementations may include one or more of the following advantages. A stable current mirror circuit is provided—i.e., a current feedback loop in the current mirror circuit (used to perform base current compensation) is provided that does not have a tendency to oscillate. The current mirror circuit does not require additional capacitors to stabilize the current feedback loop. In addition, base current compensation is achieved in a current mirror circuit using a minimum number of circuit elements that can be easily scaled for reduced power consumption and size. In addition, the current mirror circuit requires minimum input headroom—i.e., the current mirror circuit can have an input voltage designed to be a few hundred millivolts above a base voltage associated with a compensating bipolar transistor.

The details of one or more implementations are set forth in the accompanying drawings and the description below. Other features and advantages will be apparent from the description and drawings, and from the claims.

DESCRIPTION OF DRAWINGS

Like reference symbols in the various drawings indicate like elements.

DETAILED DESCRIPTION

Figure 1:
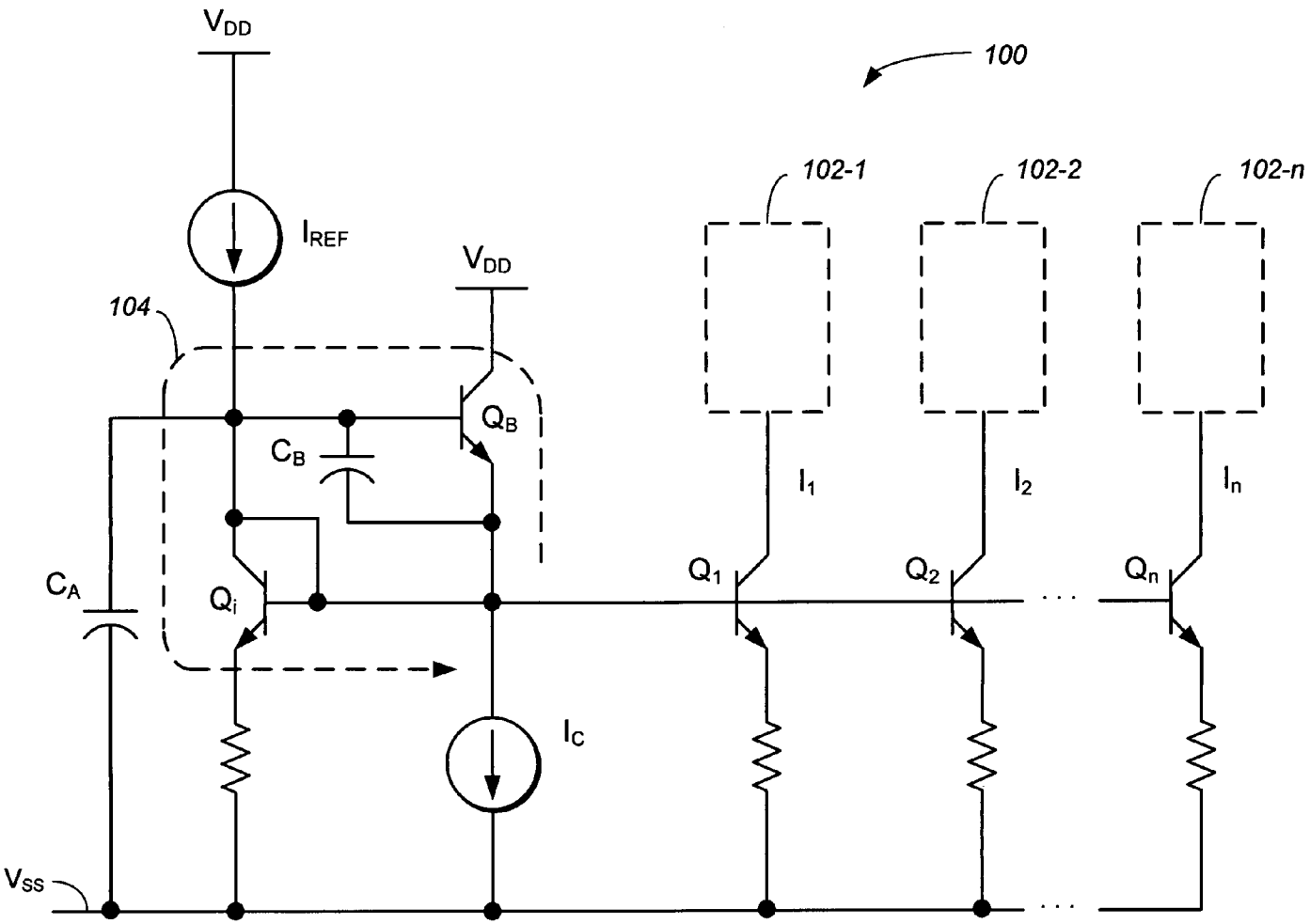
FIG. 1 (PRIOR ART)
FIG. 1 is a schematic diagram of a conventional current mirror circuit.
Figure 2:
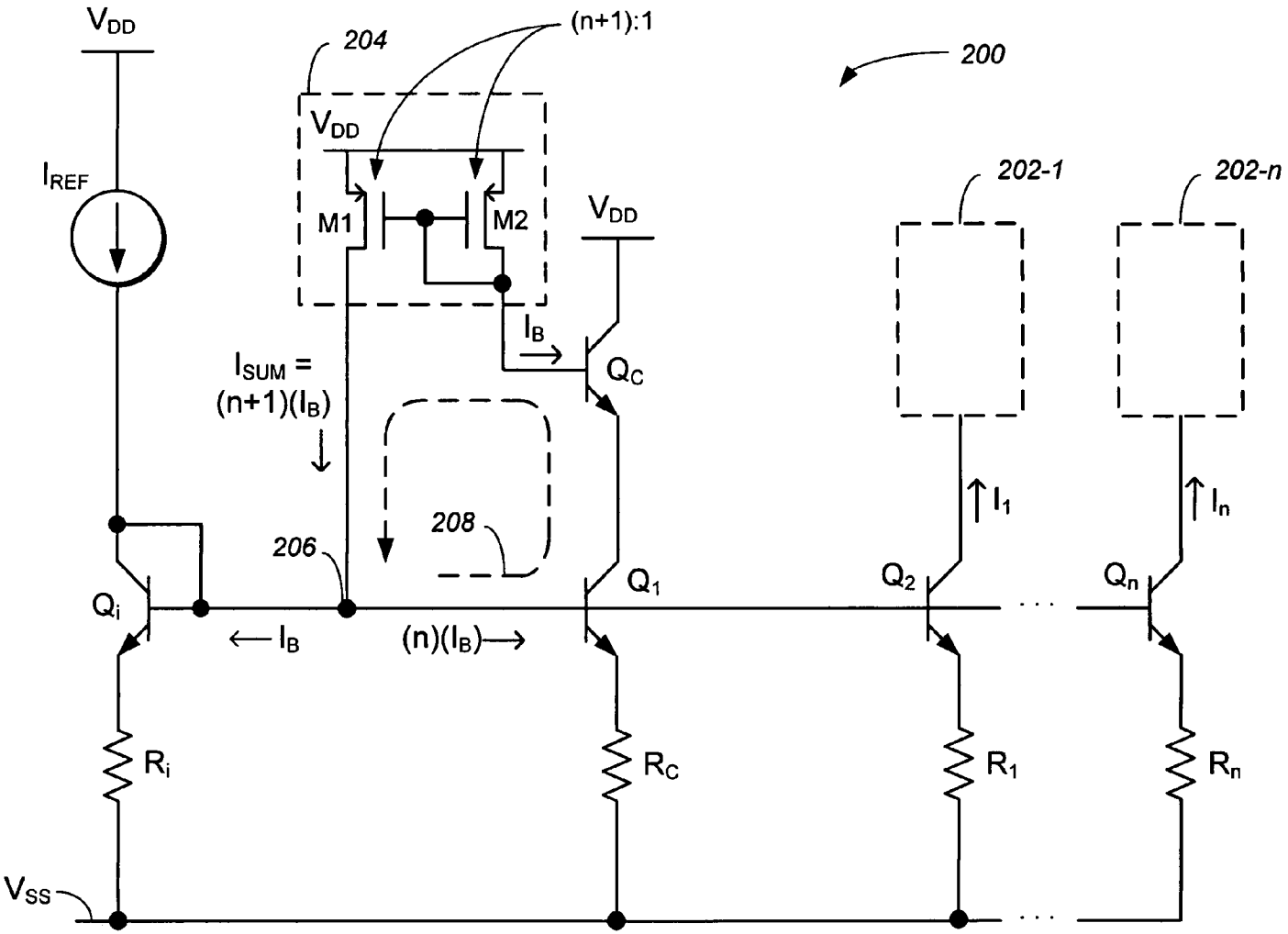
FIG. 2 is a schematic diagram of a current mirror circuit.

FIG. 2 shows a current mirror circuit 200 with base current compensation that outputs a plurality of output currents $I_1, \ldots I_n$, where n is an integer that is greater than zero. Output currents $I_1, \ldots I_n$ can be supplied to a plurality of electrical circuits 202-1, . . . 202-n, respectively. Electrical circuits 202-1, . . . 202-n can be various types of electrical circuits that require a current source (or a bias current). In one implementation, current mirror circuit 200 includes a master (NPN) bipolar transistor $Q_i$, and slave (NPN) bipolar transistors $Q_1, \ldots Q_n$ having bases that are commonly connected. In one implementation, master bipolar transistor $Q_i$ and slave bipolar transistors $Q_1, \ldots Q_n$ have emitter areas of substantially a same size.

The emitters of master bipolar transistor $Q_i$ and slave bipolar transistors $Q_1, \ldots Q_n$ are connected to a power supply $V_{SS}$ (e.g., ground) through corresponding resistors $R_i$, $R_C$, $R_1, \ldots R_n$. The collector of master bipolar transistor $Q_i$ is connected to a reference current source $I_{REF}$. The collectors of slave bipolar transistors $Q_2, \ldots Q_n$ are respectively connected to electrical circuits 202-1, . . . 202-n. The collector of slave bipolar transistor $Q_1$ is connected to the emitter of compensating (NPN) bipolar transistor $Q_C$. The collector of compensating bipolar transistor $Q_C$ is connected to a power supply $V_{DD}$ (e.g., 5V), and the base of compensating bipolar transistor $Q_C$ is connected to a drain of p-type MOSFET transistor M2. The source of MOSFET transistor M2 is connected to power supply $V_{DD}$. The gate of MOSFET transistor M2 is connected to the drain of MOSFET transistor M2, and also connected to a gate of p-type MOSFET transistor M1.

MOSFET transistors M1, M2 form a current mirror circuit 204 that uses a base current of compensating bipolar transistor $Q_C$ as a reference current. In one implementation, the size ratio—i.e., the width-to-length ratio—of MOSFET transistor M2 to MOSFET transistor M1 is 1:(n+1), where n is equal to a number of slave transistors having bases that are commonly connected to master bipolar transistor $Q_i$. The source of MOSFET transistor M1 is connected to power supply $V_{DD}$, and the drain of MOSFET transistor M1 is connected to a junction between bases of master bipolar transistor $Q_i$ and slave bipolar transistor $Q_1$, referred to herein as node 206. The drain of MOSFET transistor M1 forms the output of current mirror circuit 204 which supplies an output current $I_{SUM}$ to node 206.

Base current-related errors in slave bipolar transistors $Q_1, \ldots Q_n$ are compensated by a current feedback loop 208 formed by slave bipolar transistor $Q_1$, compensating bipolar transistor $Q_C$ and MOSFET transistors M1, M2. In an implementation where master bipolar transistor $Q_i$ and slave bipolar transistors $Q_1, \ldots Q_n$ have emitter areas of substantially a same size, base current-related errors are reduced (or eliminated) when an equal amount of base current flows to each of slave bipolar transistors $Q_1, \ldots Q_n$ as flows to master bipolar transistor $Q_i$. Operation of current feedback loop 208 will now be described.

Slave bipolar transistor $Q_1$ and compensating bipolar transistor $Q_C$ each have a respective gain—i.e., current amplification factor $\beta_{Q1}$, $\beta_{Qc}$—such that the base current flowing into compensating bipolar transistor $Q_C$ is substantially equal to $I_B$, where $I_B$ represents the base current flowing into master bipolar transistor $Q_i$. In one implementation, the base current $I_B$ flowing into master bipolar transistor $Q_i$ can be expressed by the following equation:

$$I_B = \frac{I_{REF}}{\beta_{Qi}}, \quad \text{(eq. 1)}$$

where $\beta_{Qi}$, is the current amplification factor of master bipolar transistor $Q_i$.

As discussed above, the base current of compensating bipolar transistor $Q_C$ serves as a reference current source for current mirror circuit 204. In one implementation, the size ratio (i.e., the width-to-length ratio) of MOSFET transistor M2 to MOSFET transistor M1 is set to 1:(n+1) to attain an input/output current ratio (for current mirror circuit 204) of 1:(n+1), where n is the number of slave transistors having bases that are commonly connected to master bipolar transistor $Q_i$. In one implementation, output current $I_{SUM}$ of current mirror circuit 204 (through the drain of MOSFET transistor M1 to node 206) can be expressed as follows:

$$I_{SUM}=(n+1)I_B, \quad \text{(eq. 2)}$$

where $I_B$ is as given above in equation 1, and n is equal to a number of slave transistors having bases that are commonly connected to master bipolar transistor $Q_i$. At node 206, output current $I_{SUM}$ divides such that a current equal to $I_B$ flows to the base of master bipolar transistor $Q_i$ and a total current equal to $n(I_B)$ flows to bases of slave transistors $Q_1, \ldots Q_n$. Thus, an equal amount of base current substantially flows to each of slave bipolar transistors $Q_1, \ldots Q_n$ as flows to master bipolar transistor $Q_i$.

Figure 3:
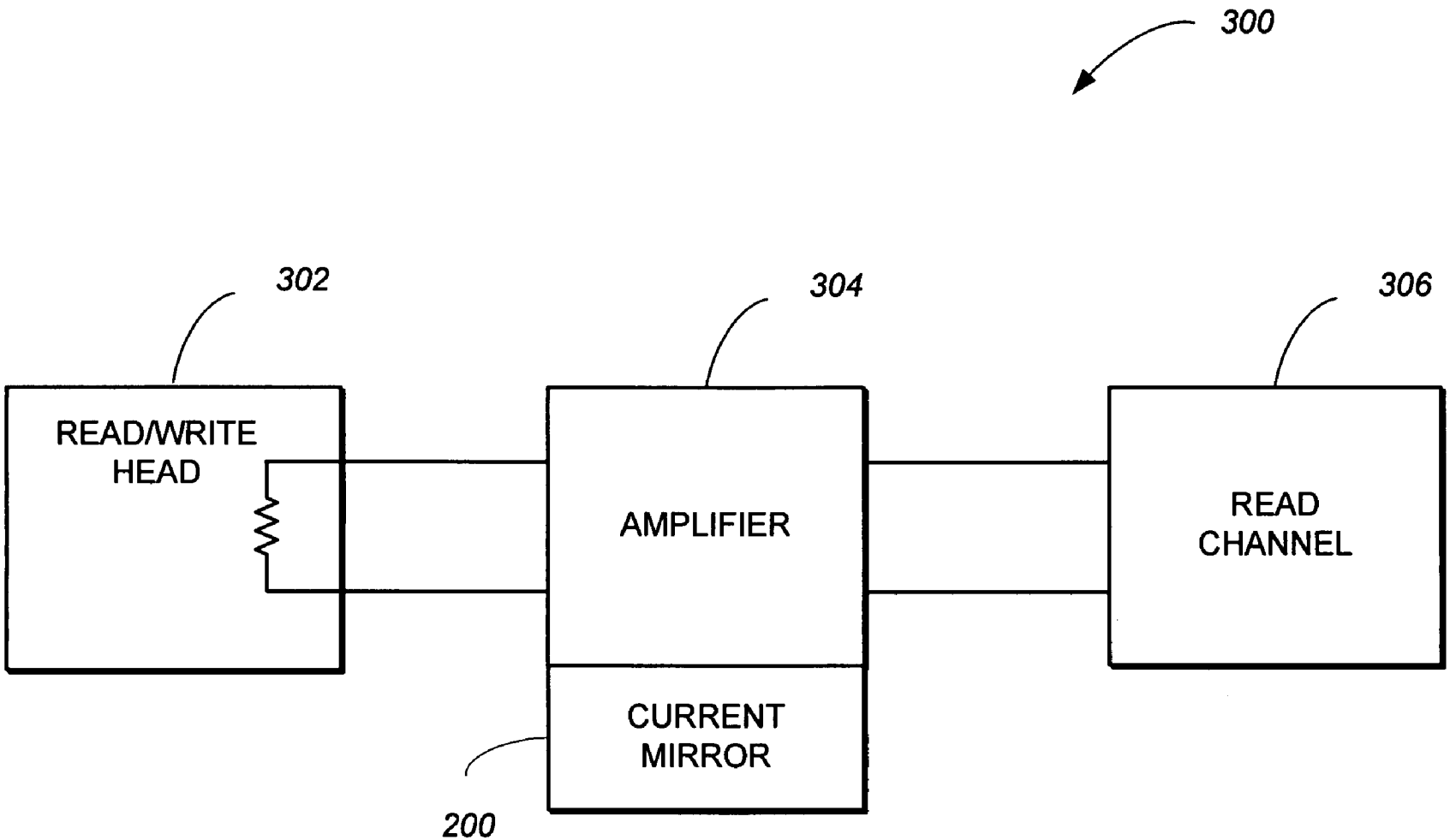
FIG. 3 is a schematic block diagram of a hard disk drive system.

Current mirror circuit 200 can be used in a wide range of applications. For example, current mirror 200 can be used with circuitry of a disk drive system 300, as shown in FIG. 3.

In a read operation, an appropriate sector of a disk (not shown) is located and data that has been previously written to the disk is detected. A read/write head 302 senses changes in magnetic flux on a surface of the disk, and generates a corresponding analog read signal. Preamplifier 304 receives the analog read signal. In one implementation, current mirror circuit 200 supplies one or more reference current sources to preamplifier 302, for amplifying the analog read signal. The amplified analog read signal is provided to read channel 306. Read channel 306 conditions the amplified analog read signal and, in one implementation, detects "zeros" and "ones" from the signal to generate a digital read signal. Read channel 306 may condition the digital read signal by further amplifying the digital read signal to an appropriate level using, for example, automatic gain control (AGC) techniques. Read channel 306 may then filter the amplified digital read signal to eliminate unwanted high frequency noise, perform data recovery, and format the digital read signal. The digital read signal can be transferred from read channel 306 and stored in memory (not shown).

Various implementations have been described. Nevertheless, it will be understood that various modifications may be made. For example, the size ratio between MOSFET transistor M2 to MOSFET transistor M1 can be set to a ratio other than 1:(n+1) based on base current requirements of one or more of master bipolar transistor $Q_i$ and slave bipolar transistors $Q_1 \ldots Q_n$. Furthermore, FIG. 2 shows current mirror circuit 200 as a current sinking type that includes master NPN bipolar transistor $Q_i$ and slave NPN bipolar transistors $Q_1, \ldots Q_n$, however, current mirror circuit 200 can be implemented as a current sourcing type having PNP bipolar transistors. In addition, MOSFET transistors M1, M2 can be substituted with bipolar transistors having different emitter areas. Accordingly, other implementations are within the scope of the following claims.

What is claimed is:

1. A circuit comprising:

a compensation circuit configured to generate a compensating base current to one or more slave bipolar transistors associated with a current mirror, the one or more slave bipolar transistors each configured to mirror a reference current source in accordance with a master bipolar transistor of the current mirror, wherein a value of the compensating base current generated by the compensation circuit is substantially equal to (n+1)IB, wherein n is equal to a total number of the one or more slave bipolar transistors, and IB represents a base current flowing to the master bipolar transistor.

2. The circuit of claim 1, wherein the compensation circuit includes:

a mirror circuit including a first transistor and a second transistor, the first transistor configured to receive a reference current equal to IB, the second transistor configured to generate an output current having a value substantially equal to (n+1)IB.

3. The circuit of claim 2, wherein the first transistor and the second transistor are sized differently.

4. The circuit of claim 3, wherein the first transistor and the second transistor are MOSFET transistors, the first transistor and the second transistor having a width to length ratio of 1:(n+1), respectively.

5. The circuit of claim 3, wherein the first transistor and the second transistor are bipolar transistors, the second transistor having an emitter area that is larger than an emitter area of the first transistor.

6. The circuit of claim 2, wherein the compensation circuit further includes a compensating bipolar transistor connected to the first transistor of the current mirror circuit and connected to the master bipolar transistor, the compensating bipolar transistor configured to supply the reference current equal to IB to the first transistor of the current mirror circuit.

7. The circuit of claim 1 wherein the compensating base current is a negative current.

8. A compensation circuit, comprising:

a first transistor of a first conductive type, the first transistor having an emitter connected to a collector of a first slave transistor in a current mirror;

a second transistor having three terminals, the second transistor having a first terminal connected to a power supply, and a second and third terminal each connected to a base of the first transistor; and a third transistor having three terminals, the third transistor having a first terminal connected to the power supply, a second terminal connected to the second terminal of the second transistor and connected to the third terminal of the second transistor, and a third terminal connected to a junction between the bases of a master transistor and the first slave transistor of the current mirror, the third transistor providing current to a base of each slave transistor in the current mirror.

9. The compensation circuit of claim 8, wherein the first conductivity type is NPN.

10. The compensation circuit of claim 8, wherein the second transistor and the third transistor are p-type MOSFET transistors.

11. The compensation circuit of claim 8, wherein the second transistor and the third transistor have a different width to length size ratio.

12. The compensation circuit of claim 11, wherein the width to length size ratio of the second transistor to the third transistor is 1:(n+1), where n is the number of transistors having bases that are commonly connected to the base of the master transistor of the current mirror.

13. The compensation circuit of claim 8, wherein the second transistor and the third transistor are bipolar transistors.

14. The compensation circuit of claim 13, wherein the bipolar transistors have different emitter areas.

15. The compensation circuit of claim 8, wherein the first conductivity type is PNP.

16. A method for generating a compensating base current for a bipolar transistor current mirror circuit, the method comprising:

generating a compensating base current that is supplied to one or more slave bipolar transistors in the current mirror circuit, wherein a value of the compensating base current is substantially equal to (n+1)IB, wherein n is equal to a total number of the one or more slave bipolar transistors, and IB represents a base current flowing to a master bipolar transistor in the current mirror circuit.

17. The method of claim 16, wherein generating a compensating base current includes using a mirror circuit having a first transistor and a second transistor to generate an output current having a value substantially equal to (n+1)IB.

18. The method of claim 17, wherein the first transistor and the second transistor of the mirror circuit are sized differently.

19. The method of claim 17, wherein the first transistor and the second transistor are MOSFET transistors, the first transistor and the second transistor having a width to length ratio of 1:(n+1), respectively.

20. The method of claim 17, wherein the first transistor and the second transistor are bipolar-transistors, the second transistor having an emitter area that is larger than an emitter area of the first transistor.

21. The method of claim 16, wherein generating a compensating base current includes using a compensating bipolar transistor that is coupled at one terminal to supply a reference current equal to IB and at a second terminal to a first slave transistor of the current mirror circuit.

22. A circuit comprising:

compensating means configured to generate a compensating base current to one or more slave means associated with a current mirror, the one or more slave means each configured to mirror a reference means in accordance with a master means of the current mirror, wherein a value of the compensating base current generated by the compensating means is substantially equal to (n+1)IB, wherein n is equal to a total number of the one or more slave means, and IB represents a base current flowing to the master means.

23. The circuit of claim 22, wherein the compensating means includes receiving means for receiving a reference current source equal to IB and generating means for generating an output current having a value substantially equal to (n+1)IB.

24. The circuit of claim 23, wherein the receiving means and the generating means are sized differently.

25. The circuit of claim 23, wherein the receiving means and the generating means comprise MOSFET transistors having a width to length ratio of 1:(n+1), respectively.

26. The circuit of claim 23, wherein the receiving means and the generating means comprise bipolar transistors, the bipolar transistor associated with the generating means having an emitter area that is larger than an emitter area of the bipolar transistor associated with the receiving means.

27. The circuit of claim 23, wherein the compensating means further includes means for supplying a reference current equal to IB to the receiving means.

* * * * *